US006283590B1

(12) United States Patent
Peter

(10) Patent No.: US 6,283,590 B1
(45) Date of Patent: Sep. 4, 2001

(54) LIQUID INK PRINTER INCLUDING A NON-SCORCHING DRYER ASSEMBLY

(75) Inventor: Kenneth C. Peter, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/411,216

(22) Filed: Oct. 4, 1999

(51) Int. Cl.[7] ..... B41J 2/01
(52) U.S. Cl. ..... 347/102; 400/582
(58) Field of Search ..... 347/102, 101, 347/18, 21; 101/487, 488; 400/582

(56) References Cited

U.S. PATENT DOCUMENTS

| | | | | |
|---|---|---|---|---|
| 2,306,607 | | 12/1942 | Horton | 34/23 |
| 4,970,528 | | 11/1990 | Beaufort et al. | 346/25 |
| 5,757,407 | * | 5/1998 | Rezanka | 347/102 |
| 5,991,506 | * | 11/1999 | Platsch | 392/379 |
| 6,008,829 | * | 12/1999 | Wakamiya et al. | 347/156 |
| 6,059,406 | * | 5/2000 | Richtsmeier et al. | 347/102 |
| 6,076,921 | * | 6/2000 | Rezanka et al. | 347/102 |
| 6,078,344 | * | 6/2000 | Wen et al. | 347/102 |
| 6,088,931 | * | 7/2000 | Aylor et al. | 34/267 |

* cited by examiner

*Primary Examiner*—John S. Hilten
*Assistant Examiner*—Darius N. Cone
(74) *Attorney, Agent, or Firm*—Tallam I. Nguti

(57) ABSTRACT

A non-scorching dryer assembly for drying a liquid ink image printed on a sheet of paper. The non-scorching dryer assembly includes a housing defining a portion of a sheet moving path; a sheet transport assembly for moving a sheet of paper carrying a liquid ink image on a front side thereof through the housing and along the portion of the sheet moving path; a heating system for heating the sheet of paper to a temperature sufficient to dry the liquid ink image thereon; and a forced air moving device connected to the housing for gently blowing air onto a side of the sheet of paper so as to prevent the sheet of paper from reaching a scorching temperature.

6 Claims, 1 Drawing Sheet

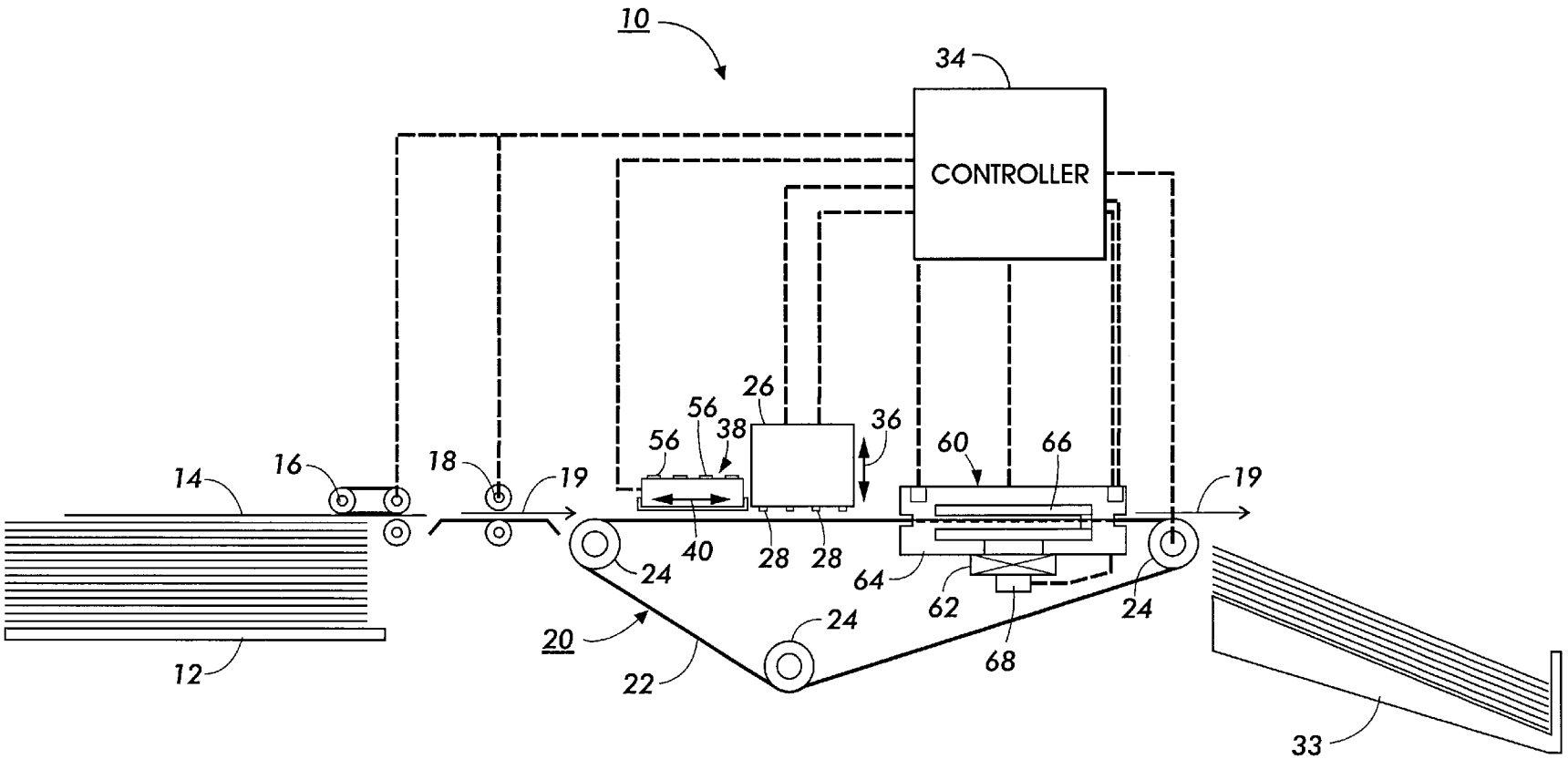
CONTROLLER
34
10
33
19
24
66
68
60
62
64
36
28
26
38
56
40
22
20
18
16
14
12

LIQUID INK PRINTER INCLUDING A NON-SCORCHING DRYER ASSEMBLY

BACKGROUND OF THE INVENTION

The present invention relates to liquid ink printers such as ink jet printers, and more particularly to such a printer including a non-scorching dryer for drying sheets carrying liquid ink images that are still wet without scorching such sheets even when such sheets are stalled in the such dryer. Printing in ink jet printers demands that excess moisture (generally water) on the surface of printed sheets be removed within a set time period and before the sheets are stacked. If the sheets are stacked before the images are dry, image smearing and offset occur. Devices that actively remove moisture, specifically water, from the sheet surface are referred to as dryers. A commonly used dryer is a hot air convective mass transfer drying system. While dryers are effective in rapidly removing the excess moisture from the sheets, dryers greatly increase printer power requirements and size. If dryers were used in small printers, the size and cost of these printers would greatly increase. Also, most small printers do not have the power capacity to accommodate an active dyer.

U.S. Pat. No. 4,970,528 to Beaufort et al. discloses an ink jet printing apparatus having a uniform heat flux dryer system which uses an infrared bulb and reflectors to transmit heat to the printed paper during the ink drying process. The freshly printed sheet is dried as it is fed from the printing apparatus along a 180.degree arc which surrounds the infrared bulb and reflectors.

U.S. Pat. No. 2,306,607 to Horton discloses a web drying device for sheets printed by an intaglio printing apparatus. The web drying device feeds the web along a series of rollers while exposing the web to heat blown onto the web by an exhaust fan. The prior art references all teach the use of some type of active heating element to dry the freshly printed sheets. As discussed above, these active dryers demand increased printer power capacity and also increase the size and cost of the printing apparatus which is unacceptable for a small, relatively inexpensive printer.

Thermal ink jet printing systems that require an ink drying system can benefit from the use of an infra red dryer due to its fast warm up time and fast energy transfer rate. However, unless the power density that the media is exposed to is very low (less than 0.8 watts/cm), scorching as evidenced by darkening, deformation, and odor, can occur if the media is exposed to the IR energy for longer the designed time such as during an undetected paper jam.

SUMMARY OF THE INVENTION

In accordance with the present invention, there is a provided a nonscorching dryer assembly for drying a liquid ink image printed on a sheet of paper. The non-scorching dryer assembly includes a housing defining a portion of a sheet moving path; a sheet transport assembly for moving a sheet of paper carrying a liquid ink image on a front side thereof through the housing and along the portion of the sheet moving path; a heating system for heating the sheet of paper to a temperature sufficient to dry the liquid ink image thereon; and a forced air moving device connected to the housing for gently blowing air onto a side of the sheet of paper so as to prevent the sheet of paper from reaching a scorching temperature.

BRIEF DESCRIPTION OF THE DRAWINGS

In the detailed description of the invention presented below, reference is made to the drawings, in which:

The FIGURE is a schematic elevational view of a liquid ink printer including the non-scorching dryer in accordance with the present invention.

DETAILED DESCRIPTION OF THE INVENTION

While the present invention will be described in connection with a preferred embodiments thereof, it will be understood that it is not intended to limit the invention to those embodiments. On the contrary, it is intended to cover all alternatives, modifications, and equivalents as may be included within the spirit and scope of the invention as defined by the appended claims.

Referring to FIG. 1, it illustrates a schematic elevational view of a liquid ink printer 10, for instance, an ink jet printer, incorporating a non-scorching dryer assembly of the present invention, shown generally as 60. The liquid ink printer 10 includes an input tray 12 containing sheets of a sheet of paper 14 to be printed upon by the printer 10. Single sheets of the sheet of paper 14 are removed from the input tray 12 by a pickup device 16 and fed by feed rollers 18 to a transport mechanism 20. The transport mechanism 20 moves the sheet by a feed belt or belts 22 driven by one of support rollers 24 beneath a liquid ink printhead assembly 26.

The printhead assembly 26, for example, includes one or more page width printheads 28 supported in a printing position by a printhead support (not shown) in a confronting relation with the belt 22. During printing, the page width printheads 28 image-wise deposit droplets of liquid ink onto the sheet of paper 14 as it is carried by the belt 22 past and beneath the plurality of printheads 28. As is well known, each of the page width printheads 28 includes an array of print nozzles, for instance, staggered or linear arrays, having a length sufficient to image-wise deposit droplets of ink as above, within a printing zone that lies below the printheads and is crossed the sheet of paper 14.

It is however understood that the present invention is equally applicable, however, to printers having partial width array ink jet printheads. The printhead assembly 26 also includes an ink supply (not labeled) either attached to the printhead support or coupled to the page width printheads through appropriate supply tubing. In either case, as the sheet of paper 14 is moved through the printing zone, the printheads 28 print or record a liquid ink image on the sheet of paper 14.

After printing or recording of the liquid ink image as above within the printing zone, the sheet of paper 14 is then carried by the belt 22 through the non-scorching dryer assembly 60 of the present invention (to be described in detail below) for drying the liquid ink image thereon. From the non-scorching dryer 60, the sheet of paper 14, with a dried ink image thereon is moved to an output tray 33. As shown, a controller 34 controls the operation of various aspects of the printer 10, including the transport mechanism 20 and the non-scorching dryer 60 of the present invention. The transport mechanism 20 for example includes the pickup device 16, the feed roller 18, the belt 22 and the drive rollers 24. In addition, the controller 34 controls the movement of the printhead assembly 26, printing by the printheads 28 as would be understood by one skilled in the art. The controller 34 is preferably a self-contained, dedicated mini-computer having a central processor unit (CPU), electronic storage, and a display or user interface (UI). With the help of sensors and connections (not shown), the controller 34 reads, captures, prepares and manages the flow of data for the image being printed by the printheads 28. In addition, the controller 34 is the main multi-tasking processor for operating and controlling all of the other machine subsystems and printing operations.

At the completion of a printing job or when otherwise necessary, such as during a power failure, the printhead assembly 26, which is movable in the directions of an arrow 36, is moved away from the belt 22 such that a capping assembly 38, movable in the directions of the arrow 40, is moved beneath the printhead assembly 26 for capping thereof. Once the cap assembly 38 is positioned directly beneath the printhead assembly 26, the printhead assembly 26 is moved towards the belt 22 and into contact with a plurality of capping gaskets 56 located on the cap assembly 38.

When the printhead assembly 26, capped as above, is again needed for another printing job, it is moved away from the belt 22 and the cap assembly 38 then moves away from the printhead assembly 26 such that the printhead assembly 26 can be repositioned appropriately with respect to the belt 22 for printing on the recording sheets 14. In addition to the cap assembly 38, the ink jet printer 10 may includes a maintenance assembly (not shown) for actively cleaning, maintaining and priming the printheads 28.

As pointed out above (background section), printing with liquid ink in ink jet printers ordinarily demands that excess moisture (generally water) in the liquid ink forming a printed image on the surface of the sheet of papers be removed within a set time period, and before the sheets are stacked. This is because if the sheets are stacked before the images are dry, undesirable image smearing and offset occur. Dryer devices that have a fast warm up time and fast energy transfer rate would be preferable.

Infrared dryers have been found to have fast warm up times and fast energy transfer rates, and so accordingly the printer 10 includes the non-scorching infrared dryer assembly 60 in accordance with the present invention. When infrared dryers are used, unless the power density that the sheet of paper is exposed to is very low (less than 0.8 watts/cm), scorching resulting in darkening, deformation, and odor, ordinarily can occur. If the sheet of paper, for example jams, and is thus exposed to the IR energy of the infra red heater for longer than the designed time for the sheet of paper to move through the infra red heater.

As illustrated, the non-scorching dryer assembly 60 of the present invention is connected to the controller 34 for operational control, and includes a housing 64 defining a portion of the sheet path 19; a sheet transport assembly, for example belt 22, for moving a sheet 14 of paper carrying a liquid ink image on a front side thereof through the housing 64, and along the portion of the sheet path 19. The non-scorching dryer assembly 60 also includes a heating system 66 for heating the liquid ink image on the sheet of paper to a temperature sufficient to dry the liquid ink image. The heating system 66 comprises an Infrared (IR) heating element that has a sufficiently high power density, for example, a power density within a range of 1.5 to 2.5 watts/cm, so as to enable adequate drying of printed sheets even in high throughput printers. The Infrared (IR) heating system 66 for example consists for example of an etched foil heater element that is mounted to a ceramic insulator and reinforced with a fiberglass mounting mesh with adhesive. A voltage (not shown) is applied to the non-scorching dryer assembly 60 by an IR power source which preferably is 120 VAC.

Importantly, in order to prevent the sheet of paper 14 (if stalled within the non-scorching dryer assembly 60), from reaching a scorch temperature at such power levels, the non-scorching dryer assembly 60 of the present invention includes a forced air moving device or fan 62, driveable by a drive motor 68, for gently blowing cooling air flow on and cooling the stalled sheet of paper 14 during such a stall or jam. The forced air moving device 62 is connected to the housing 64 for gently blowing air onto a side of the sheet 14 of paper carrying a liquid ink image so as to prevent the sheet of paper from reaching a scorching temperature, particularly if stalled within the non-scorching dryer assembly 60.

Advantageously, the non-scorching dryer assembly 60 of the present invention keeps paper temperature during a jam condition below scorch level without degrading the performance of the IR dryer. It also allows the use of higher power densities than could otherwise be used, thus enabling the use of infra red dryers within higher speed ink jet print engines. For such cooling, care should be taken because, if airflow over the printed image is above the 10–50 cm/second range that is desirable to carry away evaporated moisture, excessive cooling of the ink occurs and dryer efficiency is reduced. In accordance with the present invention, it is preferred to maintain a greater than 100 cm/sec air flow over the back (i.e., non-image) side of the sheet 14. It has been found that the time required to reach scorch temperature is greatly extended with such back side cooling while having no adverse impact on drying efficiency. This thus allows the use of IR power beyond 0.8 watts/cm while maintaining a scorch safety margin. Such safety can be increased further by: having the IR heating element 66 and the fan 62 on a shared power circuit, and by the use of pressure switch interlock that does not allow the IR element to operate if airflow is not present.

Low power density IR dryers are not acceptable for liquid ink printers with a high throughput rate, or for those requiring a short dryer because of space constraints. Low power density IR dryers in such printers do not allow enough time for adequate drying of the ink images to occur. As such, the non-scorching dryer assembly 60 cannot merely be designed with a low enough power density so that the sheet 14 will not be heated to its scorch temperature (205 degrees C. for paper) even with extreme dwell times in the dryer, as can occur during a jam or stalling of the sheet transport assembly 20.

The non-scorching dryer assembly 60, is preferably an Infrared (IR) power non-scorching dryer assembly and consists for example of an etched foil heater element that is mounted to a ceramic insulator and reinforced with a fiberglass mounting mesh with adhesive. A voltage is applied to the non-scorching dryer assembly 60 by an IR power source which preferably is 120 VAC. The sheet of paper 14 after printing thereon ordinarily is moved along the sheet path, through the print zone 38 and through the non-scorching dryer assembly 60, at a process speed of about 2 inches per second. The foil heater element of the non-scorching dryer assembly 60 is spaced a distance of approximately 0.6 inches above the sheet path. The liquid ink forming the print on the sheet 16 normally will be dried in about 2 to 7 seconds, and the size of the non-scorching dryer assembly 60 is such that such drying is achieved before the sheet, at the process speed, reaches the output tray 33.

As can be seen, there has been provided a non-scorching dryer assembly for drying a liquid ink image printed on a sheet of paper. The non-scorching dryer assembly includes a housing defining a portion of a sheet moving path; a sheet transport assembly for moving a sheet of paper carrying a liquid ink image on a front side thereof through the housing and along the portion of the sheet moving path; a heating system for heating the sheet of paper to a temperature sufficient to dry the liquid ink image thereon; and a forced air moving device connected to the housing for gently blowing air onto a side of the sheet of paper so as to prevent the sheet of paper from reaching a scorching temperature. While this invention has been described in conjunction with a particular embodiment thereof, it shall be evident that many alternatives, modifications and variations will be apparent to those skilled in the art. Accordingly, the present invention is intended to embrace all such alternatives, modifications and variations as fall within the spirit and broad scope of the appended claims.

What is claimed is:

1. A non-scorching dryer assembly for drying a liquid ink image printed on a sheet of paper, the non-scorching dryer assembly comprising:

(a) a housing defining a portion of a sheet moving path;

(b) a sheet transport means for moving a sheet of paper carrying a liquid ink image on a front side thereof through said housing and along said portion of the sheet moving path;

(c) a heating element for heating the liquid ink image to a temperature sufficient to dry the liquid ink image;

(d) a forced air moving device connected to said housing for selectively and gently blowing air onto a side of the sheet of paper to cool the sheet so as to prevent the sheet of paper from reaching a scorching temperature during interrupted sheet movement through said housing; and (e) a controller connected to said forced air moving device for controllably blowing air onto the sheet only when there is interrupted sheet movement through said housing of the sheet within said housing.

2. The non-scorching dryer assembly of claim 1, wherein said heating element comprises an infra red heating element.

3. The non-scorching dryer assembly of claim 1, wherein said forced air moving device is connected to said housing for gently blowing air onto a non-image carrying back side of the sheet of paper carrying the liquid ink image.

4. An ink jet printing machine for printing a liquid ink image on a sheet of paper moving along a sheet path through a printing zone therein, the ink jet printing machine, comprising:

(a) a frame;

(b) a printhead mounted to said frame and containing liquid ink for depositing image-wise onto the sheet of paper to form a liquid ink image; and (c) a non-scorching dryer assembly mounted to said frame along the sheet path for drying the ink image on the sheet of paper, the nonscorching dryer assembly comprising:

(i) a housing defining a portion of the sheet path;

(ii) a sheet transport means for moving a sheet of paper carrying a liquid ink image on a front side thereof through said housing and along said portion of the sheet path;

(iii) a heating element for heating the liquid ink image on the sheet of paper to a temperature sufficient to dry the liquid ink image;

(iv) a forced air moving device connected to said housing for selectively and gently blowing air onto a side of the sheet to cool the sheet so as to prevent the sheet of paper from reaching a scorching temperature during interrupted sheet movement through said housing; and (d) a controller connected to said forced air moving device for controllably blowing air onto the sheet only when there is interrupted sheet movement through said housing of the sheet within said housing.

5. The ink jet printing machine of claim 4, wherein said heating element of said non-scorching dryer assembly comprises an infra red heating element.

6. The ink jet printing machine of claim 5, wherein said forced air moving device of said non-scorching dryer assembly is connected to said housing for gently blowing air onto a non-image carrying back side of the sheet of paper.

* * * * *